United States Patent [19]

Brugerolle

[11] Patent Number: 4,818,262

[45] Date of Patent: Apr. 4, 1989

[54] AIR DISTILLATION PROCESS AND PLANT

[75] Inventor: Jean-Renaud Brugerolle, Paris, France

[73] Assignee: L'Air Liquide, Societe Anonyme Pour L'Etude Et L'Exploitation des Procedes Georges Claude, Paris, France

[21] Appl. No.: 26,792

[22] PCT Filed: Jul. 9, 1986

[86] PCT No.: PCT/FR86/00247

§ 371 Date: Feb. 6, 1987

§ 102(e) Date: Feb. 6, 1987

[87] PCT Pub. No.: WO87/00609

PCT Pub. Date: Jan. 29, 1987

[30] Foreign Application Priority Data

Jul. 15, 1985 [FR] France ..... 85 10796

[51] Int. Cl.[4] ..... F25J 3/04

[52] U.S. Cl. ..... 62/22; 62/30; 62/33; 62/39

[58] Field of Search ..... 62/9, 11, 22, 23, 24, 62/27, 29, 32, 33, 34, 38, 39, 41

[56] References Cited

U.S. PATENT DOCUMENTS

| | | | |
|---|---|---|---|
| 2,280,383 | 4/1942 | DeBaufre | 62/22 X |
| 2,547,177 | 4/1951 | Simpson | 62/22 X |
| 4,022,030 | 5/1977 | Brugerolle | 62/30 |
| 4,137,056 | 1/1979 | Golovko | 62/22 X |
| 4,433,989 | 2/1984 | Erickson | 62/22 X |
| 4,533,375 | 8/1985 | Erickson | 62/22 |

FOREIGN PATENT DOCUMENTS

| | | |
|---|---|---|
| 2204376 | 8/1972 | Fed. Rep. of Germany . |
| 2169561 | 9/1973 | France . |
| 2550325 | 2/1985 | France . |

*Primary Examiner*—Steven E. Warner

*Attorney, Agent, or Firm*—Young & Thompson

[57] ABSTRACT

Liquid oxygen and gaseous nitrogen are remixed in a roughly reversible manner in an auxiliary column (3); rich liquid without argon, withdrawn at an intermediate place of the auxiliary column is remixed in another auxiliary column section (4) with impure nitrogen of the top of a low pressure column (6), and the gas of the top of this auxiliary section constitutes a residual gas (R1) of the plant. Application in the production of argon.

17 Claims, 9 Drawing Sheets

R1
G
(K1)
3B
2A
LR
(K3)
4
LP

ARGON
LR
6A
2
LP
6
19
1
14
OL
7
3A
(K2)
MP
5
AIR
LR1
LR
G

AIR DISTILLATION PROCESS AND PLANT

The present invention relates to the technique of distilling air by means of a plant provided with an argon-producing column.

As is well known, air distillation plants provided with an argon-producing column usually comprise a double column formed by a medium distillation column operating at about 6 bars, a low pressure distillation column operating at a little above atmospheric pressure, and a condenser-vaporizer. The air is sent, after having been purified and cooled, to the bottom of the medium pressure column. The "rich liquid" (air enriches in oxygen) received at the bottom of the medium pressure column is fed to an intermediate point of the low pressure column, while a part of the "poor liquid," formed almost entirely by nitrogen, received at the top of the medium pressure column is refluxed to the top of the low pressure column. Below the rich liquid inlet, the low pressure column is connected to the argon-producing column through a conduit termed "argon tapping conduit" and a conduit for the return of liquid poorer in argon. The low pressure column is usually provided at the bottom with gaseous oxygen and liquid oxygen withdrawing conduits, and the medium pressure column is usually provided at the top with gaseous nitrogen and liquid nitrogen withdrawing conduits. The vapor at the top of the low pressure column ("impure nitrogen") is formed by nitrogen containing up to a few % oxygen and is usually rejected to the atmosphere.

In plants adapted mainly to produce gaseous oxygen delivered directly to a user through piping, oxygen is sometimes temporarily in excess. This is the case in particular during periods in which the factories of the user stop work. With conventional distillation plants, the gaseous oxygen is then put into communication with the atmosphere and the energy used for the separation of this oxygen is lost. FR-A-2,550,325 proposes a solution for limiting this drawback. This solution has the advantage of being simple but is of limited effectiveness.

More generally, the distillation of a given flow of air is capable of providing about 21% of this flow as oxygen and, under certain conditions, this quantity of oxygen is in excess of the real needs, whereas other productions, in particular argon, are desired.

An object of the invention is to permit in all cases the optimum valorization of the excess of oxygen so as to increase the desired productions and in particular that of argon.

The invention therefore provides a process for distilling air by means of a plant comprising a main distillation apparatus associated with an argon producing column through an argon tapping conduit, this process being characterized in that it comprises:

sending to the base of a first mixing column section gaseous nitrogen which may be impure but is substantially without argon, and to the top of a second mixing column section liquid oxygen which may possibly be impure but is substantially without argon;

sending to the base of the second section at least a part of the top vapor of the first section and to the top of the first section at least a part of the liquid produced at the base of the second section;

effecting between the base of the first section and the top of the second section at least one intermediate withdrawal which constitutes a residual gas or from which such a gas is produced, which gas is a mixture of nitrogen and oxygen comprising about 10 to 30% oxygen;

discharging from the second section, at the top of the latter, impure oxygen containing at the most a few % nitrogen; and discharging from the first section, at the base of the latter, poor liquid constituted by nitrogen containing at the most a few % oxygen, and refluxing said poor liquid to the main distillation apparatus.

The invention also provides a plant adapted to carry out such a process. This plant, which is of the type comprising a main distillation apparatus associated with an argon producing column through an argon tapping conduit, is characterized in that it comprises:

a first mixing column section and means for feeding gaseous nitrogen which may be impure but is substantially without argon to the base of said section;

a second mixing column section, and means for feeding liquid oxygen which may be impure but is substantially without argon to the top of said section;

means for feeding at least a part of the top vapor of the second section to the base of the second section and at least a part of the liquid produced at the base of the second section to the top of the first section;

intermediate withdrawing means provided between the base of the first section and the top of the second section;

means for refluxing the liquid produced at the base of the first section in the main distillation apparatus; and means for discharging the top vapor of the second section from the latter.

A few examples of modes of carrying out the invention will now be described with reference to the accompanying drawings, in which.

Hereinafter, an apparatus for exchanging matter and heat and having the structure of a distillation column, i.e. comprising a packing or a number of plates of the type used in distillation, is termed "column" or "column section".

Figure 1:
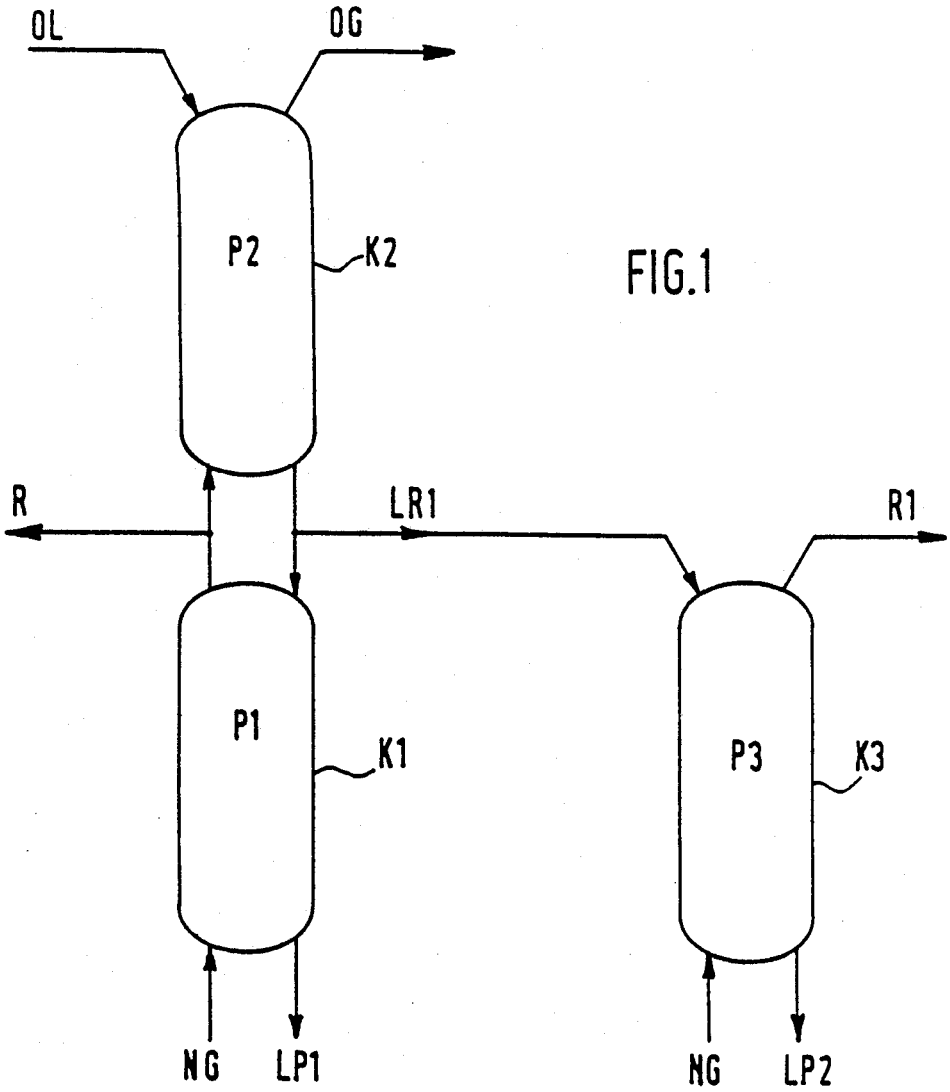
FIG. 1 is a diagram illustrating the basic principle of the invention.

FIG. 1 illustrates by a diagram the manner in which a convention air distillating plant, shown in more detail in the other Figures, is modified in accordance with the invention.

There are added to the conventional plant at least two mixing column sections K1 and K2 operating under two pressures P1 and P2 which may be equal or unequal, as will be seen hereinafter.

The column K1 is fed at its base with gaseous nitrogen which may contain up to a few % oxygen but is substantially devoid of green (i.e. containing less than 1% argon and preferably less than 0.05% argon), while the section K2 is fed at its top with liquid oxygen substantially without argon (with the same significance as before) and nitrogen. The top vapor of the section K1 is sent to the base of the section K2 and the bottom liquid of the latter is refluxed to the top of the section K1. Withdrawn from the base of the latter is poor liquid LP1, constituted by nitrogen containing up to a few % oxygen, and withdrawn from the top of the section K2 is impure oxygen, i.e. oxygen containing up to about 15% nitrogen and preferably about 5 to 10% nitrogen.

To effect these two withdrawals, there is effected at least one intermediate withdrawal between the base of the section K1 and the top of the section K2 so as to constitute a residual gas of the plant comprising a mixture of oxygen and nitrogen having about 10 to 30% oxygen, and therefore having a composition in the neighborhood of that of air but without argon.

In the embodiment illustrated in FIG. 1, the intermediate withdrawal is effected between the sections K1 and K2. It may be constituted by top vapor of the section K1, which also directly delivers the residual gas R. In some cases, it may be preferable to withdrawal bottom liquid LR1 from the section K2, this liquid being formed by a mixture of oxygen and nitrogen having a content of oxygen of about 40 to 75%; this liquid is then sent to the top of a third mixing column section K3 operating under a pressure P3 and fed at its base, as is the section K1, with gaseous nitrogen which may be impure but is substantially without argon; The residual gas R1 is then withdrawn from the top of the section K3 while the bottom liquid of this section constitutes poor liquid LP2 constituted, as is the liquid LP1, by nitrogen containing up to a few % oxygen.

The liquids LP1 and LP2 are refluxed in the plant so as to improve the distillation; the impure gaseous oxygen withdrawn from the top of the section K2 may constitute a production gas, or may be purified so as to produce pure gaseous oxygen, as will be understood hereinafter. The origin of the liquid oxygen and of the gaseous nitrogen flow or flows will be apparent from the following description.

If the pressures P1, P2 and P3 differ from one another, there will be used suitable expansion means (valves or turbines) between the mixing column sections. Further, if P1=P3, the sections K1 and K3 operate under identical conditions and may be combined into a single column section, as will be seen hereinafter with reference to FIG. 9.

In any case, the diagram in FIG. 1 ensures a remixing of liquid oxygen and gaseous nitrogen, both of which are roughly devoid of argon, under conditions close to reversibility, which corresponds to a recovery of energy. This energy appears in the form of a refrigerating transfer of the heat pump type between the liquid oxygen and the poor liquid LP1 - LP2 and may be utilized for increasing productions of the plant other than oxygen, namely gaseous nitrogen under pressure, liquid productions and above all argon, as will appear from the following description. Note that the aforementioned technical effect would also be obtained by feeding liquid oxygen containing up to a few % nitrogen as impurity to the top of the section K2.

FIGS. 2 to 9 show several embodiments employing the basic principle illustrated in FIG. 1, with double-column air distillation plants. In these Figures, certain conduits and conventional elements (in particular the heat exchangers) of double-column plants have been omitted for reasons of clarity of the drawings.

Figure 2:
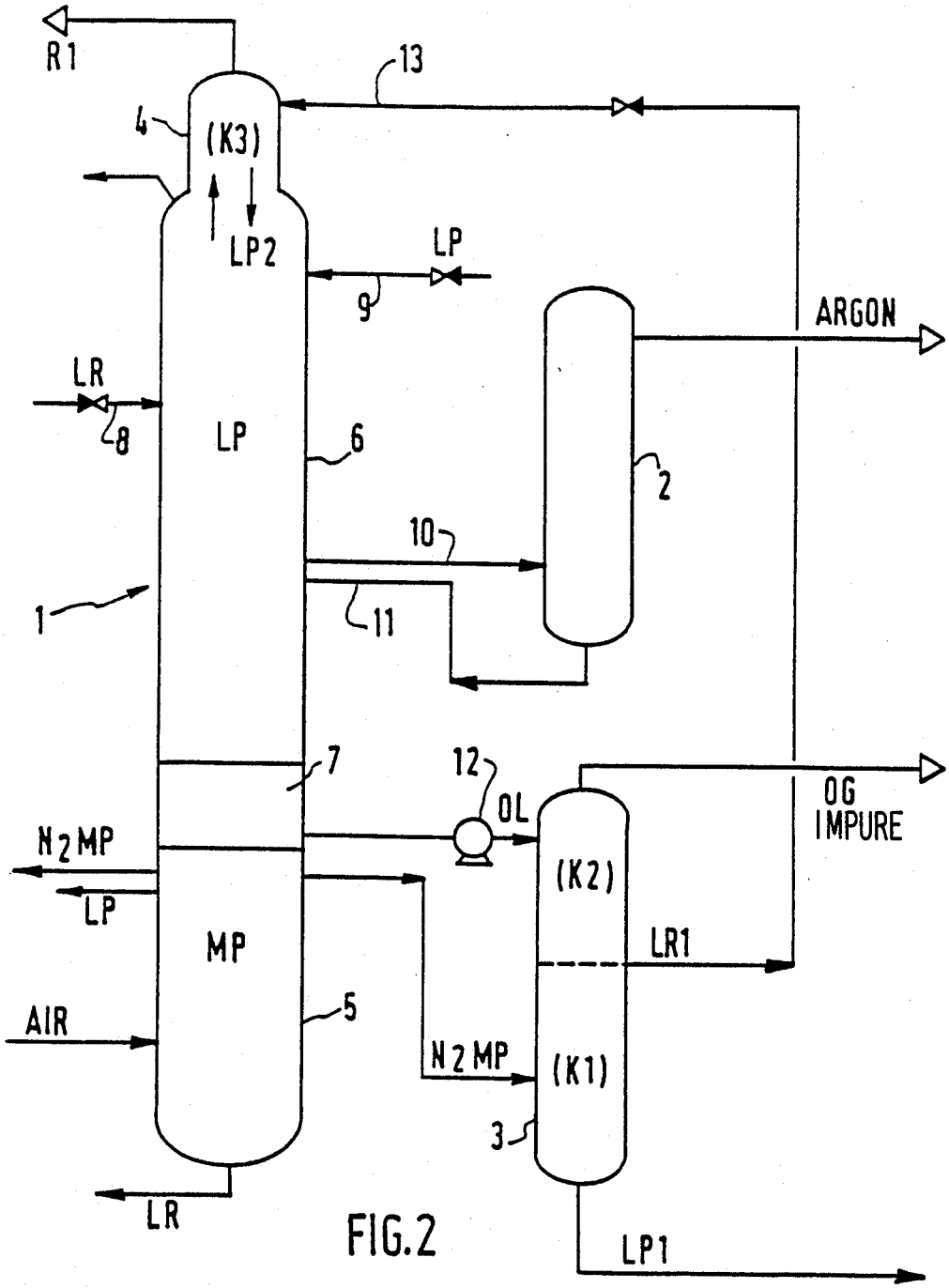
FIG. 2 represents diagrammatically an air distilling plant according to the invention.

The air distillation plant shown in FIG. 2 is adapted to produce, on one hand, impure oxygen containing about 5 to 10% oxygen and, on the other hand, argon, and possibly nitrogen. It mainly comprises a double column 1, an argon producing column 2, a remixing column 3 and a remixing minaret 4. The double column 1 comprises conventionally a lower column 5 operating under a medium pressure MP on the order of 6 absolute bars, an upper column 6 operating under a low pressure LP which is slightly higher than atmospheric pressure and a vaporizer-condenser 7 which puts into thermal exchange relation the bottom liquid (substantially pure liquid oxygen) of the low pressure column with the top vapor (substantially pure nitrogen) of the medium pressure column.

The air to be treated, compressed to 6 bars, purified and cooled in the neighborhood of its dew point, is injected into the bottom of the medium pressure column. The bottom liquid of this column, which is rich in oxygen (rich liquid LR having about 40% oxygen) contains the quasitotality of the oxygen and the argon of the entering air; it is expanded and injected at 8 at an intermediate place of the low pressure column, while top liquid of the column 5 (liquid poor in oxygen LP) is expanded and injected at 9 into the top of the low pressure column.

Below the point 8, an argon tapping conduit 10 sends a gas roughly devoid of nitrogen into the column 2, and a conduit 11 returns the bottom liquid of this column 2, which is a little less rich in argon, at roughly the same level in the low pressure column. The impure argon (argon mixture) is extracted from the top of the column 2 and then purified in the conventional way.

The column 3 operates under the medium pressure of the plant and combines the mixing column sections K1 and K2 of FIG. 1, with P1=P2. It is fed at its base with nitrogen withdrawn from the top of the medium pressure column 5 and at the top with liquid oxygen taken from the bottom of the low pressure column 6 and brought to the medium pressure by a pump 12. In the column 3, the descending liquid oxygen and the rising gaseous nitrogen are remixed in a relatively reversible manner so that there are obtained:

at the bottom of the column 3, additional poor liquid LP1, constituted by nitrogen containing up to a few % oxygen, which may be added to the poor liquid issuing from the medium pressure column to increase at 9 the reflux in the low pressure column;

at the top of the column 3, impure gaseous oxygen (oxygen containing less than 15% nitrogen, for example about 5 to 10% nitrogen) at 6 bars; and at an intermediate place of the column 3, which may be considered to be located between the lower sections K1 and the upper section K2 of the column 3, rich liquid LR1 constituted by a mixture of nitrogen and oxygen in a content which depends on the level of the withdrawal, it being possible for this content to vary for example from 40 to 75% oxygen and being for example in the neighborhood of that of the rich liquid LR.

As the two fluids introduced at the top and bottom of the column 3 are substantially devoid of argon, the same is true of the three fluids withdrawn from this column, in particular the impure oxygen thus produced contains substantially solely nitrogen as impurity.

The remixing minaret 4 constitutes the mixing column section K3 of FIG. 1. Its base directly communicates with the top of the low pressure column 6. It is therefore fed with impure nitrogen (nitrogen containing up to a few % oxygen) at its base. At its top, this minaret is fed at 13 with rich liquid LR1 coming from the column 3 and suitably expanded. The relatively reversible remixing of impure nitrogen and rich liquid LR1 produces an additional quantity of poor liquid LP2 constituted by nitrogen containing up to a few % oxygen, which falls into the column 1 and increases therein the reflux. At the top of the minaret 4, the residual gas R1 devoid of argon and having a composition in the neighbourhood of that of air is discharged.

In the conventional manner, a part of the rich liquid LR or LR1 may be expanded and vaporized in a condenser at the top of the column 2 and then returned to the column 6 in the vicinity of level 8. Further, as shown, a part of the top vapor of the column 6 may be withdrawn, for example so as to produce by distillation in an auxiliary column section (not shown) pure nitrogen under low pressure.

Assuming that the whole of the liquid oxygen produced in column 6 is sent into column 3, the plant of FIG. 2 permits the production of nitrogen and impure oxygen in addition to argon. To obtain pure oxygen which will be withdrawn in the conventional manner from the bottom of the low pressure column, the diagram of FIG. 3 may be used which has the advantage of not disturbing the operation of the argon producing column 2.

Figure 3:
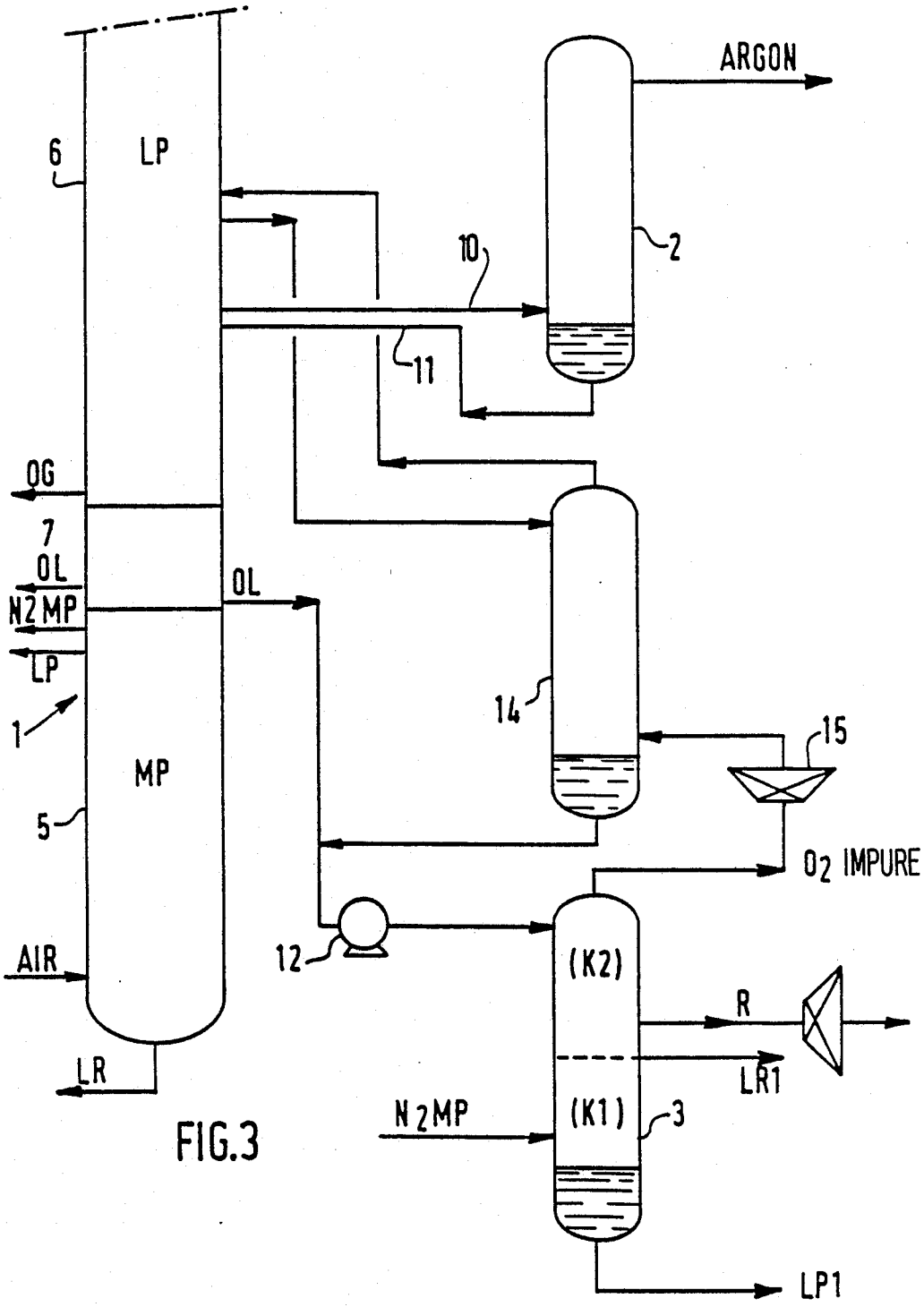
FIG. 3 represents diagrammatically a part of a variant of the plant of FIG. 2, and FIGS. 4 to 10 represent diagrammatically other embodiments of the plant according to the invention.

It can be seen in FIG. 3 that liquid is taken from the low pressure column a few plates above the argon tapping point 10, and sent to the top of an auxiliary low pressure column 14; the latter is fed at its base with impure oxygen coming from the mixing column 3, expanded to low pressure in a turbine 15. The bottom liquid of the column 14 is impure oxygen devoid of argon which is added, upstream of the pump 12, to the pure liquid oxygen withdrawn from the low pressure column. All the argon contained in the liquid injected at the top of the column 14 issues with the top vapor of this column and is returned to the low pressure column 6 at roughly the same level as the withdrawal of said liquid.

Thus, there is effected in column 14 a separation of the oxygen and the argon parallel with that which occurs in the lower part of the column 6, but in the presence of a ballast of 5 to 10% nitrogen. The quantity of liquid oxygen returned from the bottom of the column 14 to the column 3 no longer needs to be withdrawn from the bottom of the column 6, which enables the same quantity of pure oxygen as a product to be withdrawn from the base of this column 6.

In the plants of FIGS. 2 and 3, the withdrawal of liquid oxygen from the bottom of the column 6 for feeding the column 3 is equivalent to an increase in the heating of this column. There is thus obtained in the column 6 an increase both in the reflux at the top and in the heating of the bottom; the distillation therein is consequently improved, which may be taken advantage of for increasing the yield of the extraction of argon and/or productions of the plant other than gaseous oxygen: the complementary medium pressure nitrogen may be used directly as a product under pressure or work expanded so as to produce cold and therefore to increase the production of liquid (liquid nitrogen or liquid oxygen) of the plant. The increase in the production of liquid of the plant may moreover by achieved in another way in plants employing a blowing of air in the low pressure column by increasing the work expanded air flow. These various possibilities are illustrated in FIGS. 4 to 8. It is also possible to envisage, for the same purpose, the work expansion of a flow of residual gas R withdrawn at an intermediate place of the column 3, as shown in FIG. 3.

Figure 4:
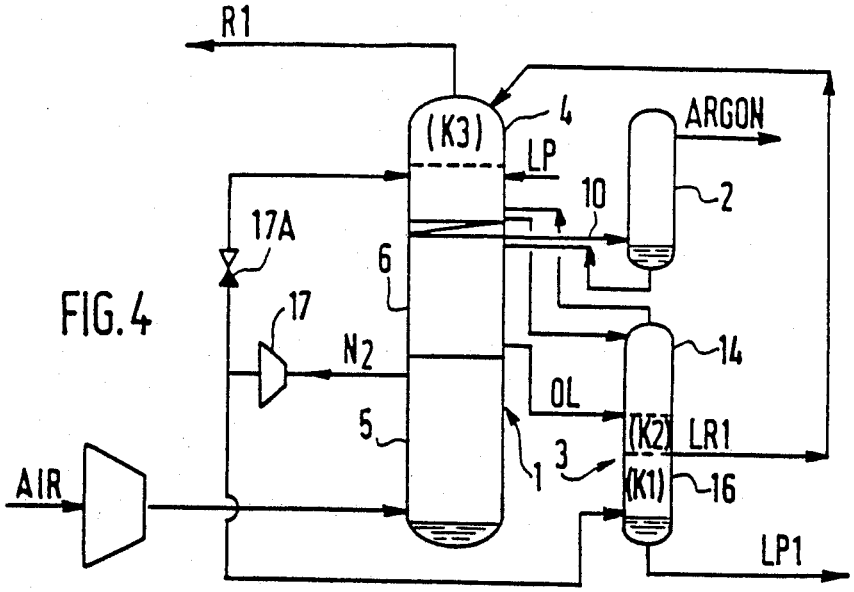

In FIG. 4, the column 3 operates in the neighborhood of low pressure and receives directly at the top liquid oxygen coming from the bottom of column 6. Consequently, the turbine 15 of FIG. 3 is eliminated and the columns 3 and 14 are united within a single shell 16. The bottom of column 3 is fed with nitrogen obtained by expansion in a medium pressure nitrogen turbine 17. As shown, medium pressure nitrogen expanded in the turbine 17 and then in an expansion valve 17A can also be blown into the top of column 6.

Figure 5:
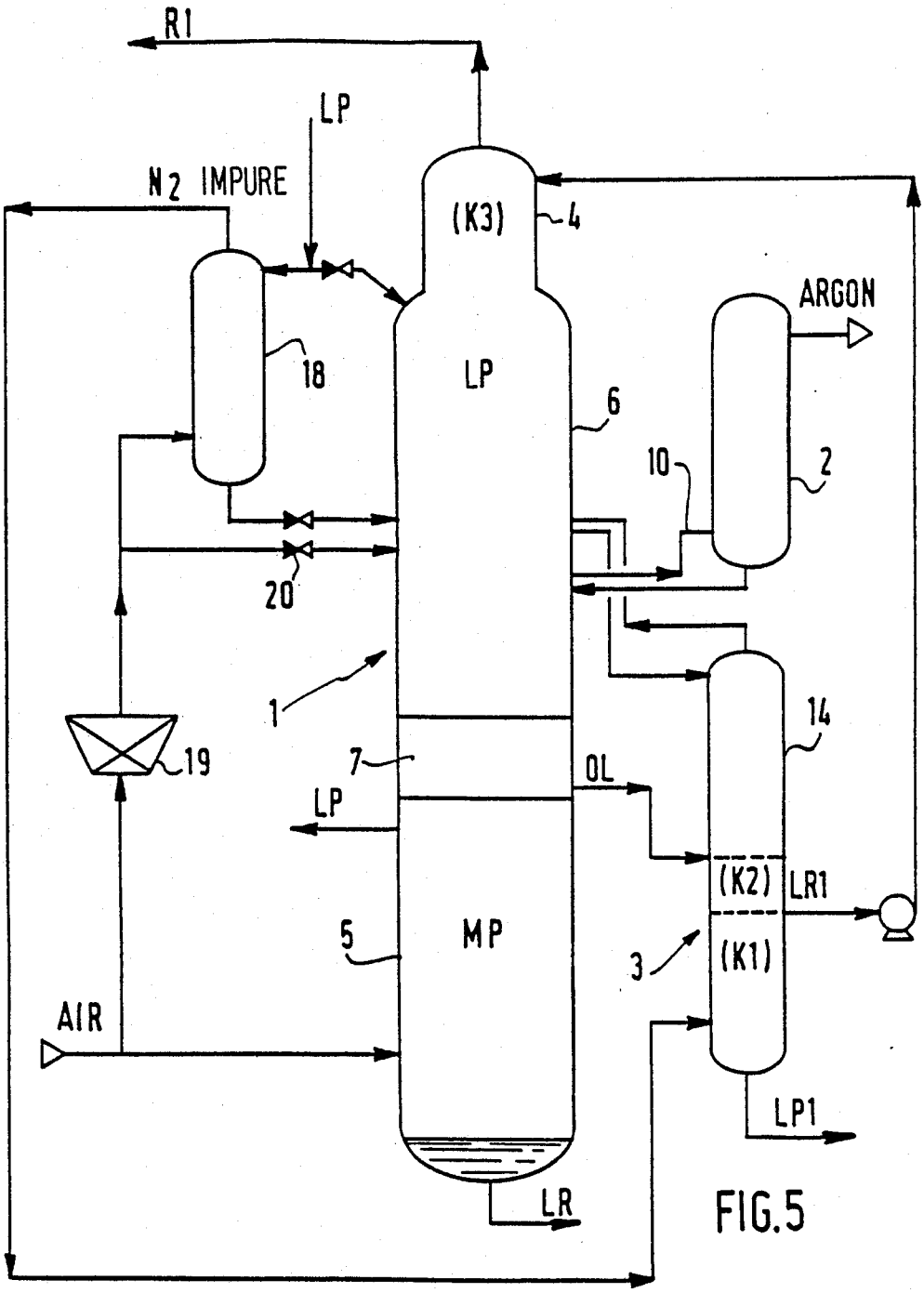

FIG. 5 shows another means for feeding low pressure nitrogen to the base of column 3: the upper part of column 6 is combined with an auxiliary column 18 operating under a somewhat higher pressure, for example 1.8 bars as against 1.4 bars for the column 6.

A part of the treated air flow is diverted and expanded to 1.8 bars in a turbine 19. A part of the work expanded flow is sent to the base of the column 18 which receives at the top, as does the column 6, poor liquid under the appropriate pressure. The rest of the work expanded air is expanded to 1.4 bars in an expansion valve 20 and blown into the column 6 together with the liquid of the bottom of column 18. It is impure nitrogen, containing up to a few % oxygen and substantially no argon, withdrawn from the top of the column 18, which is used for feeding the base of the column 3.

Figure 6:
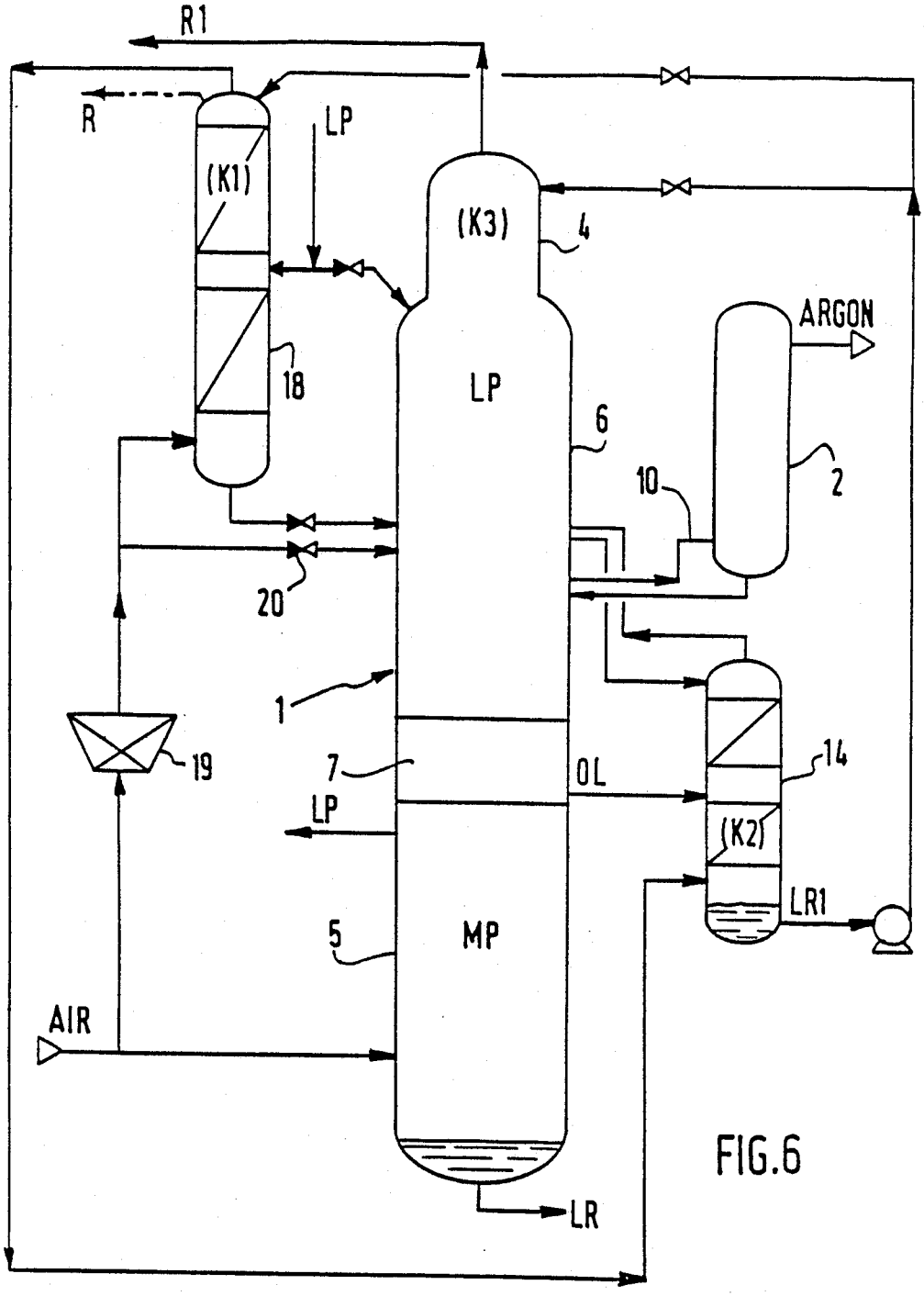

FIG. 6 illustrates a radiant of FIG. 5 which eliminates the pump (not shown) for raising the liquid LP1. For this purpose, the section K1 is transferred to above the column 18 in the same shell as the latter, and the liquid LR1 is divided between the top of the minaret 4 and that of the section K1. As a variant, the conduit provided with the valve 20 may be eliminated and all the work expanded air may be distilled in the column 18. There is then produced at the top of the section K1 a second residual gas R, as indicated by the dot-dash line in FIG. 6.

In the plants of FIGS. 5 and 6, the residual gas R1 issues from the minaret 4 under a pressure on the order of 1.3 bars which is sufficient for it to be used for the regeneration of adsorption cylinders (not shown) for purifying the entering air. This is advantageous but results in a relatively high operating pressure, which is expensive as concerns the energy required to compress the entering air. Further, when use is made thereof, the throttling of the air in the valve 20 corresponds to a loss of energy.

The plant of FIG. 7 uses the principle of FIG. 5 but avoids any throttling of air and lowers the operating pressure: the column 18 is transferred to below the column 3, in the same shell; it is fed at the top with poor liquid falling from the section K1 and with an addition of poor liquid LP withdrawn from the top of column 5 and expanded in a valve 21, and fed at the bottom with the whole of the air expanded to 1.8 bars in the turbine 19. As this flow provides at the top of the column 18 a flow of impure nitrogen higher than that required for the operation of the column 3, there may be withdrawn from the latter a supplementary residual gas R, at about 1.6 bars, which may be used for the regeneration of the aforementioned adsorption cylinders. The gas R1 issuing from the minaret 4 then no longer serves for this regeneration and needs to be under a pressure only slightly higher than atmospheric pressure for overcoming the pressure drops of the thermal exchange line used for cooling the entering air. The operating pressure of the plant is in this way lowered.

Figure 7:
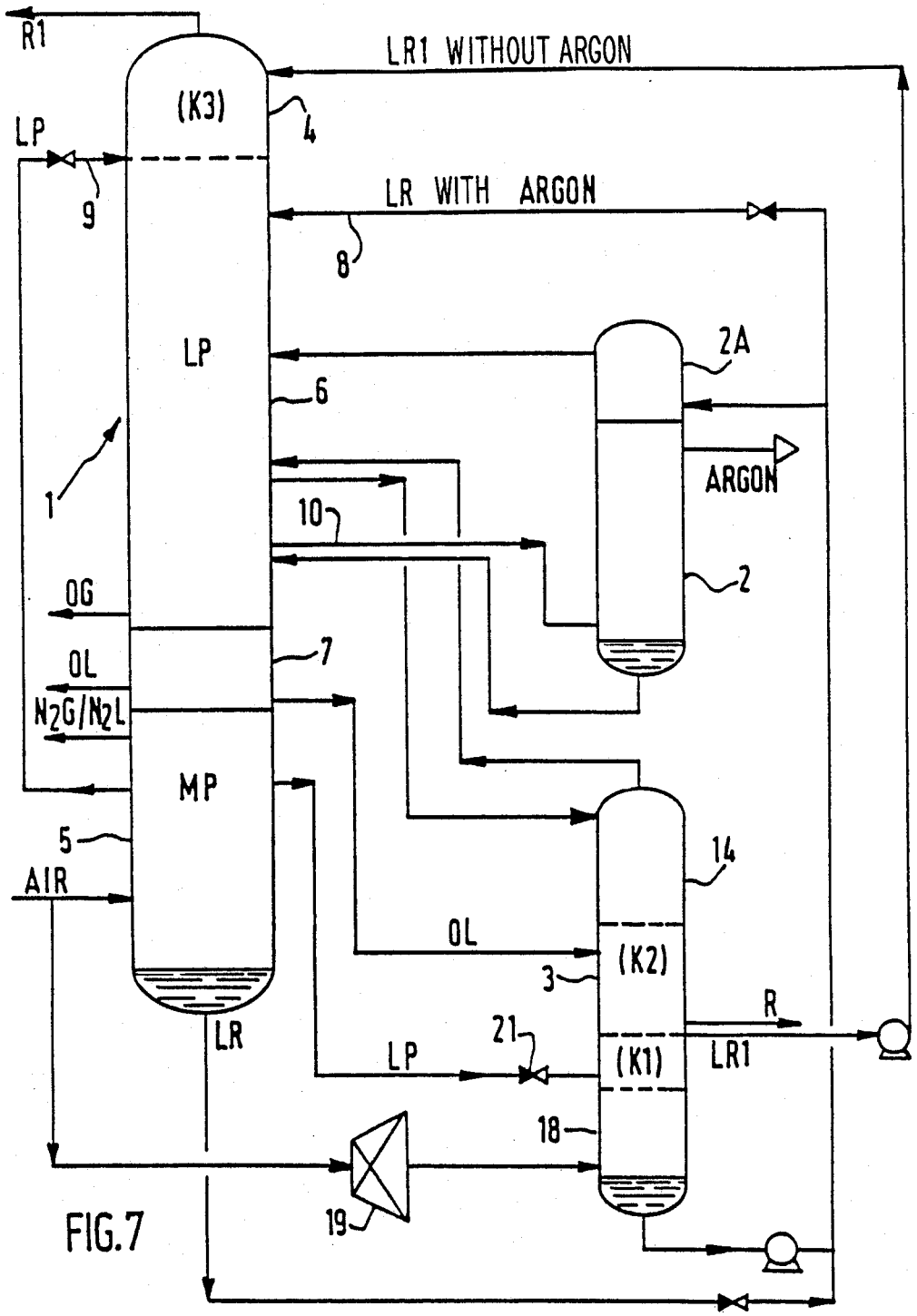

FIG. 7 shows the origin and the use of two types of rich liquid: (a) liquid rich in argon coming, on the one hand, from the bottom of the medium pressure column 5 and, on the other hand, from the bottom of the column 18; these two flows are united and are used both as reflux in the low pressure column 6 and for feeding the top condenser 2A of the column 2 in the conventional manner; and (b) rich liquid LR1 without argon, withdrawn between the sections K1 and K2 of the column 3 and sent to the top of the minaret 4. Further, in comparing this FIG. 7 with FIG. 1, it is found that there are effected between the sections K1 and K2 the two withdrawals indicated in FIG. 1, namely a direct withdrawal of residual gas R and a withdrawal of liquid LR1 which, after mixing with nitrogen, also provides residual gas R1, but under a different pressure.

Also shown in FIG. 7 are conduits for withdrawing low pressure liquid or gaseous oxygen from the column 6 and medium pressure liquid or gaseous nitrogen from the column 5.

Figure 8:
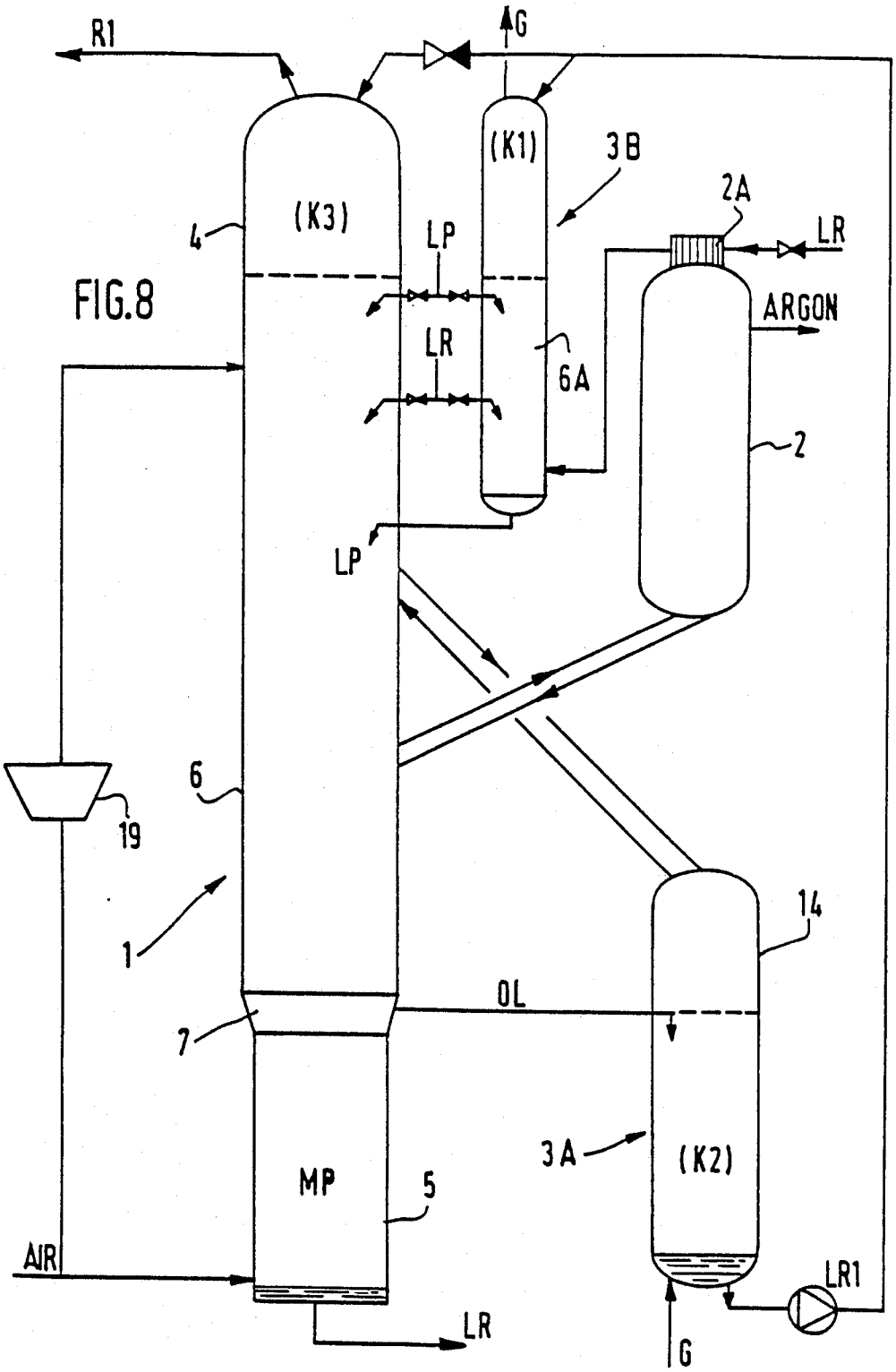

Another possibility for avoiding any loss of energy by throttling air is illustrated by the plant of FIG. 8. In this plant, there is to be found again the double column 5, 6 surmounted by the minaret 4 constituting the section K3 of FIG. 1. The air turbined in the turbine 19 is expanded to 1.3 bars and blown into the column 6. However, two auxiliary columns are used; on the one hand, a column 3A operating at 1.4 bars which unites the column 14 for purifying oxygen and, below the latter, the section K2 of FIG. 1, and, on the other hand, a column 3B operating at 1.5 bars which combines the section K1 of FIG. 1A and, below the latter, a duplicate 6A of the upper part of the low pressure column 6.

The section K2 is fed at the top with liquid oxygen withdrawn from the bottom of the column 6 and at the bottom with gas G withdrawn from the top of the column 3B, i.e. from the top of the section K1. Rich liquid without argon LR1 withdrawn from the bottom of the column 3A is returned as reflux to both the top of the column 3B and the top of the minaret 4. Poor liquid is returned as reflux to both the top of the column 6 and the top of the section 6A, while liquid rich in argon coming from the bottom of the column 5 is partly injected both into the column 6 and into the section 6A and partly vaporized in the top condenser 2A of the column 2A and then injected into the bottom of the section 6A. The very rich liquid received at the bottom of the latter is in turn injected into the column 6.

Considerations of pressure drop show that the arrangement of FIG. 8 is particularly appropriate in the case wherein at least column 2 is provided with packing. Further, it will be understood that the plant of FIG. 8 could also operate when the air expansion is replaced by a nitrogen expansion.

Figure 9:
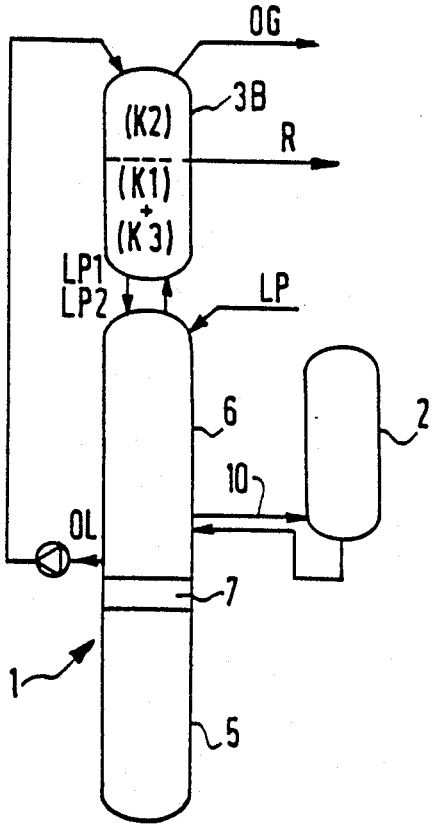

FIG. 9 shows another plant in which the sections K1 and K3 both operate at the pressure of the low pressure column 6 and are coincident. Thus, the double column is surmounted by a remixing column 3B which is fed at the top with liquid oxygen coming from the bottom of column 6 and fed at the bottom with impure nitrogen from the top of the same column 6. The bottom liquid of the column 3B is refluxed to the column 6 and impure oxygen is withdrawn from the top of the column 3B. The residual gas R is withdrawn between the section K2 on the one hand and the section K1-K3 on the other hand.

Figure 10:
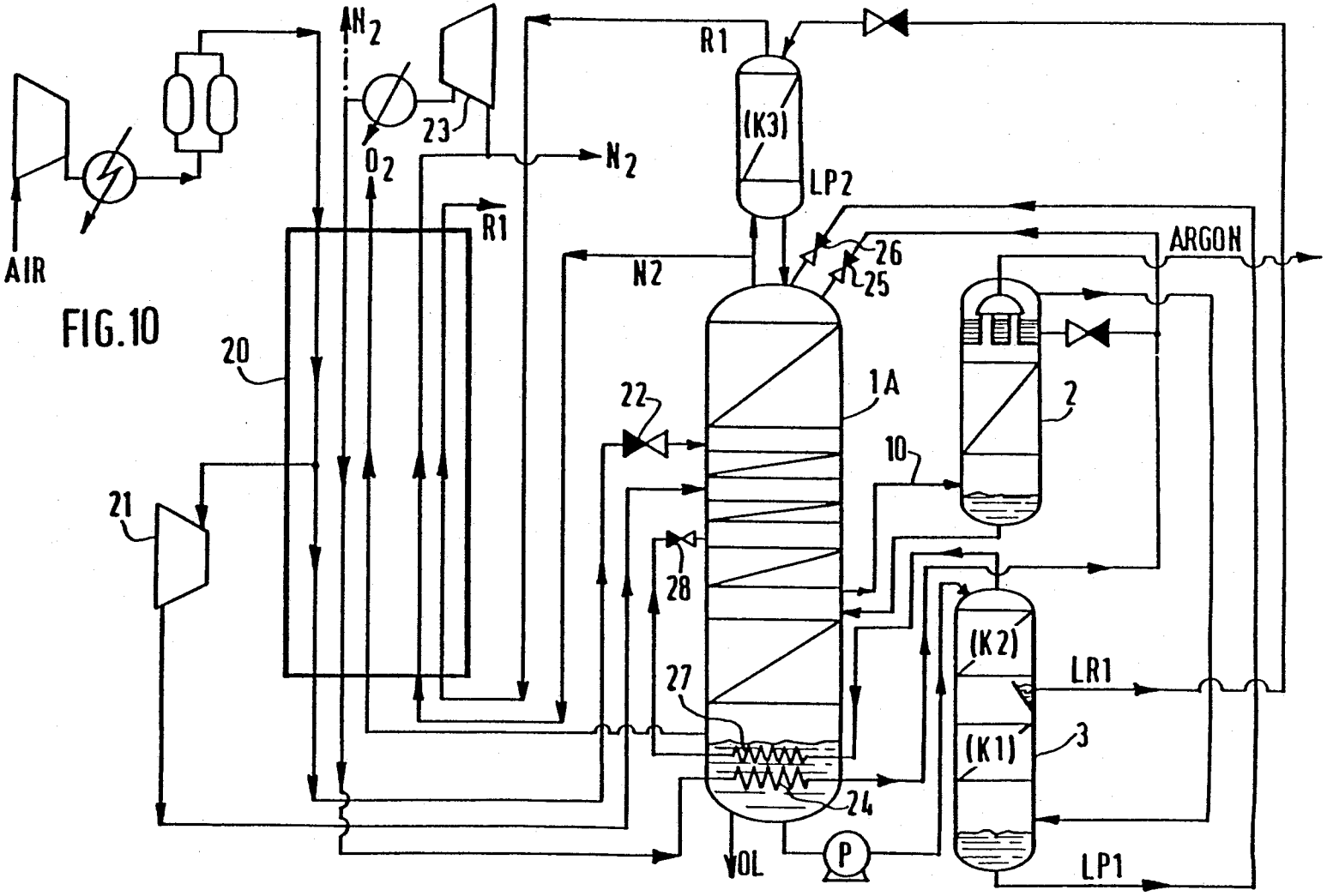

The invention is compatible not only with double column plants but also with any type of plant for distilling air comprising argon producing means. An example of such a plant having a single column is illustrated in FIG. 10 which is a more complete diagram than FIGS. 2 to 9.

In this Figure, compressed and purified air is cooled and partly liquefied in a thermal exchange line 20. The major part of the air flow is expanded to 1.5 bars in a turbine 21 (Claude cycle), then injected into the single distillation column 1A connected to the argon producing column 2. The liquefied air, expanded in a valve 22, is injected into the column. The latter produces oxygen at the bottom and nitrogen at the top. The latter gas, after heating in the exchange line 20, is partly compressed to 6 bars by a compressor 23, cooled and passes through a coiled tube 24 provided at the bottom of column 1A where it is condensed by vaporizing the liquid oxygen, then is partly expanded in a valve 25 and returned as reflux to the top of the column 1A. The rest of the condensed nitrogen is expanded in a valve 26, vaporized in the top condenser of the column 2 and then sent to the bottom of the mixing column 3 uniting the sections K1 and K2 which operate at 2 to 3 bars.

The liquid oxygen produced at the bottom of the column 1A is at least partly brought by a pump to the pressure of the column 3 and injected into the top of the latter. The gaseous impure oxygen withdrawn from the top of the column 3 is condensed in a second coiled tube 27 at the bottom of the column 1A, expanded in a valve 28 and injected into this same column 1A.

The section K3 located above the column 1A is fed at the top with rich liquid LR1 withdrawn between the sections K1 and K2 and expanded to the low pressure, and fed at the bottom with nitrogen from the top of the column 1A. This section K3 produces at the bottom poor liquid LP2 which is sent, as is the poor liquid LP1 coming from the bottom of the column 3, as reflux to the top of the column 1A; it produces at the top the residual gas R1 which is heated in the exchange line 20 before being disharged or, if the pressure is sufficient, used for regenerating the adsorbent cylinders for purifying the entering air.

As illustrated, the plant may also produce liquid oxygen, withdrawn from the bottom of the column 1A, gaseous oxygen, also withdrawn from the bottom of this column and heated in the exchange line 20, and gaseous nitrogen, withdrawn from the top of the same column, and after heating, discharged upstream of the compressor 23. As shown in dot-dash line, nitrogen at 6 bars may also be withdrawn downstream of the compressor 23.

I claim:

1. A process for high-yield argon production by means of an air distillation plant comprising a main distillation apparatus (1; 1,18; 1,6A; 1A) associated with an argon producing column (2) through an argon tapping conduit (10), comprising:

sending to the base of a first mixing column section (K1) gaseous nitrogen which may be impure but is substantially without argon, and to the top of a second mixing column section (K2) liquid oxygen which may be impure but is substantially without argon;

sending to the base of the second section (K2) at least a part of the top vapor of the first section and to the top of the first section (K1) at least a part of the liquid produced at the base of the second section;

withdrawing between the two mixing column sections a fluid flow, and forming from said fluid flow a residual gas which is a mixture of nitrogen and oxygen comprising about 10 to 30% oxygen;

discharging from the second section (K2), at the top of the later, impure oxygen containing at the most a few % nitrogen; and discharging from the first section (K1), at the base of the latter, poor liquid (LP1) constituted by nitrogen containing at the most a few % oxygen, and sending this poor liquid as reflux to the main distillation apparatus (1; 1,18; 1,6A; 1A).

2. A process according to claim 1, in which said impure oxygen contains less than 15% nitrogen.

3. A process according to claim 1, in which said fluid flow comprises a part of the top vapor (R) of the first section.

4. A process according to claim 1, in which the main distillation apparatus comprises a double column (1) which itself comprises a medium pressure column (5) operating under a relatively high pressure and a low pressure column (6) operating under a relatively low pressure and connected to the argon producing column (2) through said argon tapping conduit (10), expanding a part of the top vapor of the medium pressure column (5) in a turbine (17), operating the first mixing column section (K1) and the second mixing column section (K2) at the same pressure which is about the low pressure by feeding the first section (K1) with nitrogen withdrawn from the medium pressure column and expanded in said turbine (17) and directly feeding the second section (K2) with liquid oxygen taken from the bottom of the low pressure column (6).

5. A process according to claim 1, in which said fluid flow comprises a part of the liquid produced at the base of the second section.

6. A process according to claim 1, in which the main distillation apparatus (1, 18) comprises a double column (1) which itself comprises a medium pressure column (5) operating under a relatively high pressure and a low pressure column (6) operating under a relatively low pressure and connected to the argon producing column (2) through said argon tapping conduit (10), and operating the first and second mixing column sections (K1, K2) at a recycling pressure slightly higher than the low pressure, distilling a part of the treated air at said recycling pressure by using poor liquid as reflux, and feeding the first mixing column section (K1) with impure nitrogen resulting from this distillation.

7. A process according to claim 6, characterised in that it comprises blowing into the low pressure column (6) the excess turbined air after expansion in a valve (20).

8. A process for high-yield argon production by means of an air distillation plant comprising a main distillation apparatus (1; 1,18; 1,6A; 1A) associated with an argon producing column (2) through an argon tapping conduit (10), comprising:

sending to the base of a first mixing column section (K1) gaseous nitrogen which may be impure but is substantially without argon, and to the top of a second mixing column section (K2) liquid oxygen which may be impure but is substantially without argon;

sending to the base of the second section (K2) at least a part of the top vapor of the first section and to the top of the first section (K1) at least a part of the liquid produced at the base of the second section;

withdrawing between the two mixing column sections (K1, K2) a part of the liquid (LR1) produced at the base of the second section (K2) and forming therefrom a mixture of nitrogen and oxygen comprising about 10 to 30% oxygen by effecting a remixing of the withdrawn liquid with gaseous nitrogen which may be pure but is substantially without argon in a third mixing column section (K3), the top vapor of this third section constituting residual gas (R1) while the liquid (LP2) produced at its base constitutes refluxing supplementary poor liquid for the main distillation apparatus (1; 1,18; 1,6A; 1A), this liquid being constituted by nitrogen containing at the most a few % oxygen;

discharging from the second section (K2), at the top of the latter, impure oxygen containing at the most a few % nitrogen; and discharging from the first section (K1), at the base of the latter, poor liquid (LP1) constituted by nitrogen containing at the most a few % oxygen, and sending this poor liquid as reflux to the main distillation apparatus (1; 1,18; 1,6A; 1A).

9. A process according to claim 8, in which the main distillation apparatus comprises a double column (1) which itself comprises a medium pressure column (5) operating under a relatively high pressure and a low pressure column (6) operating under a relatively low pressure and connected to the argon producing column (2) through said argon tapping conduit (10), and operating the first and second mixing column sections (K1, K2) at the medium pressure by feeding the first section (K1) with nitrogen withdrawn from the medium pressure column (5) and the second section (K2) with liquid oxygen withdrawn from the bottom of the low pressure column (6) and brought to the same pressure.

10. An air distillation plant having a high-yield argon production, of the type comprising a main distillation apparatus (1; 1,18; 1,6A; 1A) associated with an argon producing column (2) through an argon tapping conduit (10) this installation comprising:

a first mixing column section (K1), and means for feeding the base of this section with gaseous nitrogen which may be impure but is substantially without argon;

a second mixing column section (K2), and means for feeding the top of this section with liquid oxygen which may be impure but is substantially without argon;

means for feeding the base of the second section (K2) with at least a part of the top vapor of the first section and the top of the first section (K1) with at least a part of the liquid produced at the base of the second section;

intermediate fluid withdrawing means provided between the two mixing column sections;

means for forming from said fluid a residual gas which is a mixture of nitrogen and oxygen comprising about 10 to 30% oxygen;

means for discharging said residual gas from the installation;

means for sending the liquid (LP1) to the base of the first section (K1) as reflux in the main distillation apparatus (1; 1,18; 1,6A; 1A); and means for discharging from the second section (K2) the top vapor of the latter.

11. A plant according to claim 10, of the type in which the main distillation apparatus (1) comprises a double column which itself comprises a medium pressure column (5) operating under a relatively high pressure and a low pressure column (6) operating under a relatively low pressure and connected to the argon producing column (2) through said argon tapping conduit (10), a turbine (17) for expanding the top vapor of the medium pressure column (5), means connecting an outlet of the turbine to the base of said first section, and means connecting the base of said low pressure column to the top of said second section.

12. A process for high-yield argon production by means of an air distillation plant comprising a main distillation apparatus (1; 1,18; 1,6A; 1A) associated with an argon producing column (2) through an argon tapping conduit (10), comprising:

sending to the base of a first mixing column section (K1) gaseous nitrogen which may be impure but is substantially without argon, and to the top of a second mixing column section (K2) liquid oxygen which may be impure but is substantially without argon;

sending to the base of the second section (K2) at least a part of the top vapor of the first section and to the top of the first section (K1) at least a part of the liquid produced at the base of the second section;

effecting between the base of the first section (K1) and the top of the second section (K2) at least one intermediate withdrawal (R, LR1) and forming therefrom a mixture of nitrogen and oxygen comprising about 10 to 30% oxygen;

discharging from the second section (K2), at the top of the latter, impure oxygen containing at the most a few % nitrogen; and discharging from the first section (K1), at the base of the latter, poor liquid (LP1) constituted by nitrogen containing at the most a few % oxygen, and sending this poor liquid as reflux to the main distillation apparatus (1; 1,18; 1,6A; 1A);

and condensing the impure oxygen by vaporization of liquid oxygen of the main distillation apparatus (1A), the liquid obtained being sent as reflux to this column at a level located above the argon tapping conduit (10).

13. A process for high-yield argon production by means of an air distillation plant comprising a main distillation apparatus (1; 1,18; 1,6A; 1A) associated with an argon producing column (2) through an argon tapping conduit (10), comprising:

sending to the base of a first mixing column section (K1) gaseous nitrogen which may be impure but is substantially without argon, and to the top of a second mixing column section (K2) liquid oxygen which may be impure but is substantially without argon;

sending to the base of the second section (K2) at least a part of the top vapor of the first section and to the top of the first section (K1) at least a part of the liquid produced at the base of the second section;

effecting between the base of the first section (K1) and the top of the second section (K2) at least one intermediate withdrawal (R, LR1) and forming therefrom a mixture of nitrogen and oxygen comprising about 10 to 30% oxygen;

discharging from the second section (K2), at the top of the latter, impure oxygen containing at the most a few % nitrogen; and discharging from the first section (K1), at the base of the latter, poor liquid (LP1) constituted by nitrogen containing at the most a few % oxygen, and sending this poor liquid as reflux to the main distillation apparatus (1; 1,18; 1,6A; 1A);

the main distillation apparatus comprising a double column (1) which itself comprises a medium pressure column (5) operating under a relatively high pressure and a low pressure column (6) operating under a relatively low pressure and connected to the argon producing column (2) through said argon tapping conduit (10), the process further comprising distilling the impure oxygen in an auxiliary low pressure column (14) fed with the liquid taken from the low pressure column (6) above the argon tapping conduit (10), the top vapor of this auxiliary low pressure column (14) being sent at roughly the same level into the low pressure column (6) while its bottom liquid is sent as reflux into the second mixing column section (K2).

14. A process for high-yield argon production by means of an air distillation plant comprising a main distillation apparatus (1; 1,18; 1,6A; 1A) associated with an argon producing column (2) through an argon tapping conduit (10), comprising:

sending to the base of a first mixing column section (K1) gaseous nitrogen which may be impure but is substantially without argon, and to the top of a second mixing column section (K2) liquid oxygen which may be impure but is substantially without argon;

sending to the base of the second section (K2) at least a part of the top vapor of the first section and to the top of the first section (K1) at least a part of the liquid produced at the base of the second section;

effecting between the base of the first section (K1) and the top of the second section (K2) at least one intermediate withdrawal (R, LR1) and forming therefrom a mixture of nitrogen and oxygen comprising about 10 to 30% oxygen;

discharging from the second section (K2), at the top of the latter, impure oxygen containing at the most a few % nitrogen; and discharging from the first section (K1), at the base of the latter, poor liquid (LP1) constituted by nitrogen containing at the most a few % oxygen, and sending this poor liquid as reflux to the main distillation apparatus (1; 1,18; 1,6A; 1A);

and using the residual gas (R, R1) for regenerating adsorption cylinders serving to purify the incoming air.

15. An air distillation plant having a high-yield argon production, of the type comprising a main distillation apparatus (1; 1,18; 1,6A; 1A) associated with an argon producing column (2) through an argon tapping conduit (10) this installation comprising:

a first mixing column section (K1), and means for feeding the base of this section with gaseous nitrogen which may be impure but is substantially without argon;

a second mixing column section (K2), and means for feeding the top of this section with liquid oxygen which may be impure but is substantially without argon;

means for feeding the base of the second section (K2) with at least a part of the top vapor of the first section and the top of the first section (K1) with at least a part of the liquid produced at the base of the second section;

intermediate withdrawing means provided between the base of the first section (K1) and the top of the second section (K2);

means for sending the liquid (LP1) to the base of the first section (K1) as reflux in the main distillation apparatus (1; 1,18; 1,6A; 1A);

means for discharging from the second section (K2) the top vapor of the latter;

a third mixing column section (K3), means for feeding the base of this section with gaseous nitrogen which may be impure but is substantially without argon and its top with liquid (LR1) withdrawn through said intermediate withdrawing means, and means for withdrawing from the top of this third section a residual gas of the plant (R1).

16. An air distillation plant having a high-yield argon production, of the type comprising a main distillation apparatus (1; 1,18; 1,6A; 1A) associated with an argon producing column (2) through an argon tapping conduit (10) this installation comprising:

a first mixing column section (K1), the means for feeding the base of this section with gaseous nitrogen which may be impure but is substantially without argon;

a second mixing column section (K2), and means for feeding the top of this section with liquid oxygen which may be impure but is substantially without argon;

means for feeding the base of the second section (K2) with at least a part of the top vapor of the first section and the top of the first section (K1) with at least a part of the liquid produced at the base of the second section;

intermediate withdrawing means provided between the base of the first section (K1) and the top of the second section (K2);

means for sending the liquid (LP1) to the base of the first section (K1) as reflux in the main distillation apparatus (1; 1,18; 1,6A; 1A);

means for discharging from the second section (K2) the top vapor of the latter;

the main distillation apparatus (1) comprising a double column which itself comprises a medium pressure column (5) operating under a relatively high pressure and a low pressure column (6) operating under a relatively low pressure and connected to the argon producing column (2) through said argon tapping conduit (10), an auxiliary column section (14) fed at its top with liquid withdrawn from the low pressure column (6) above the argon tapping conduit (10), means for returning the top vapor of this auxiliary column into the low pressure column roughly at the same level, the auxiliary section (14) being fed at its base with the top vapor of the second mixing column section (K2) while the bottom liquid of this auxiliary section is sent as reflux to the top of the second mixing column section.

17. An air distillation plant having a highyield argon production, of the type comprising a main distillation apparatus (1; 1,18; 1,6A; 1A) associated with an argon producing column (2) through an argon tapping conduit (10) this installation comprising:

a first mixing column section (K1), and means for feeding the base of this section with gaseous nitrogen which may be impure but is substantially without argon;

a second mixing column section (K2), and means for feeding the top of this section with liquid oxygen which may be impure but is substantially without argon;

means for feeding the base of the second section (K2) with at least a part of the top vapor of the first section and the top of the first section (K1) with at least a part of the liquid produced at the base of the second section;

intermediate withdrawing means provided between the base of the first section (K1) and the top of the second section (K2);

means for sending the liquid (LP1) to the base of the first section (K1) as reflux in the main distillation apparatus (1; 1,18; 1,6A; 1A);

means for discharging from the second section (K2) the top vapor of the latter;

the main distillation apparatus (1, 18) comprising a double column (1) which itself comprises a medium pressure column (5) operating under a relatively high pressure and a low pressure column (6) operating under a relatively low pressure and connected to the argon producing column (2) through said argon tapping conduit (10), and a turbine (19) for expanding a part of the incoming air and a second auxiliary column section (18) operating at a pressure slightly higher than the low pressure and producing at the top impure nitrogen which is fed to the base of the first mixing column section (K1).

* * * * *